US005204728A

United States Patent [19]

Braswell

[11] Patent Number: 5,204,728

[45] Date of Patent: Apr. 20, 1993

[54] UNLIMITED DOCUMENT FEEDER

[75] Inventor: Charles D. Braswell, Henrietta, N.Y.

[73] Assignee: Xerox Corporation, Stamford, Conn.

[21] Appl. No.: 744,034

[22] Filed: Aug. 21, 1991

[51] Int. Cl.[5] ..... G03G 21/00

[52] U.S. Cl. ..... 355/323

[58] Field of Search ..... 271/289, 290, 298; 355/321, 323, 209

[56] References Cited

U.S. PATENT DOCUMENTS

| | | | |
|---|---|---|---|
| 4,370,052 | 1/1983 | Murakami et al. | 355/323 |
| 4,475,806 | 10/1984 | Daughton et al. | 355/209 |
| 4,530,593 | 7/1985 | Kasuya et al. | 355/323 |
| 4,750,731 | 6/1988 | Dei et al. | 355/323 X |
| 4,834,360 | 5/1989 | Acquaviva | 271/3.1 |

*Primary Examiner*—A. T. Grimley
*Assistant Examiner*—J. E. Barlow, Jr.
*Attorney, Agent, or Firm*—Ronald F. Chapuran

[57] ABSTRACT

To enable running in a multiple document load mode, an interface procedure is used to specify more than one bin in a "bins for each set" selection and the desired bin capacity is set in the Bin Capacity selection. From 1 to 6 bins per set may be selected. The operator selects the copy quantity, places the first set of originals in the document handler and presses start print. During this job segment, if the number of copies delivered is equal to the bin capacity, then the sorters will automatically increment to the next bin. Incrementing to the next bin is only dependent on reaching bin capacity and is not related to the loads in the document handler. When copying of the first set of originals is complete, the screen reads: "LOAD MORE ORIGINALS AND PRESS START PRINT OR PRESS END JOB IF JOB DONE". The operator then loads the next set of originals and presses start print. This sequence continues until the last sets of originals is completed, the operator then presses "END JOB". The job is now complete with each output set occupying a group of consecutive bins. The number of bins per group is determined by the value set in "bins for each set".

2 Claims, 7 Drawing Sheets

UNLIMITED DOCUMENT FEEDER

BACKGROUND OF THE INVENTION

The invention relates to an unlimited document feeder, and more particularly, to automatically coordinating the use of a plurality of sorter towers with multiple bins to accommodate successive loads of the document feeder to complete a single job requirement.

High volume duplication jobs often have more originals than the document handler can process in one load. However, in general, all copier/duplicator products conclude the job when the last document in the document handler has been copied. These jobs must therefore be broken into a number of "sub" jobs, each having no more originals than the document handler can hold. The result is a manual collation task to build up the final output sets from separate parts. This is very time consuming and offers too much potential for human error.

It would be desirable, therefore, to provide a system where the completion of the last original in the ADH does not terminate the job, but instead the operator is prompted to replace the completed stack of originals with another stack and continue the job.

It is an objective, therefore, of the present invention to provide a new and improved document feeder. It is another object of the present invention to provide a document feeder and control that prompts the operator to complete discrete portions of a total job by separate loadings of the automatic document feeder. It is a further object of the present invention to use from 1 to 6 bins to store each output set to provide a delivery point for multiple original load sets.

There is prior art on the basic concepts of a copier having both an ADH and a sorter, in combination, and with so called "limitless sorting" Limitless sorting is a known copying mode alternately using two sets of sorter bins, one of the sets of bins can be filled while the other set of bins is being unloaded.

Also of particular interest as relating to the subject of "limitless sorting" is U.S. Pat. No. 4,361,320 issued Nov. 30, 1982 to H. Kikuchi, et al. It discloses a single vertical array of bins divided (functionally) into two groups when the number of copies to be collated exceeds the number of bins, thus allowing copying to operate continuously and allowing an operator to remove the collated copies from one group while copies are being collated in the other group. When the number of pages of a document exceeds a predetermined number, the first group is defined to contain more bins than the second group, thereby reducing the number of times each document page must be fed to the copier.

SUMMARY OF THE INVENTION

To enable running in a multiple document load mode, an interface procedure is used to specify more than one bin in a "bins for each set" selection and the desired bin capacity is set in the Bin Capacity selection. The operator selects the copy quantity, places the first set of originals in the document handler and presses start print. During this job segment, if the number of copies delivered is equal to the bin capacity, then the sorters will automatically increment to the next bin. Incrementing to the next bin is only dependent on reaching bin capacity and is not related to the loads in the document handler. When copying of the first set of originals is complete, the screen reads: "LOAD MORE ORIGINALS AND PRESS START PRINT OR PRESS END JOB IF JOB DONE". The operator then loads the next set of originals and presses start print. This sequence continues until the last sets of originals is completed, the operator then presses "END JOB". The job is now complete with each output set occupying a group of consecutive bins. The number of bins per group is determined by the value set in "bins for each set".

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
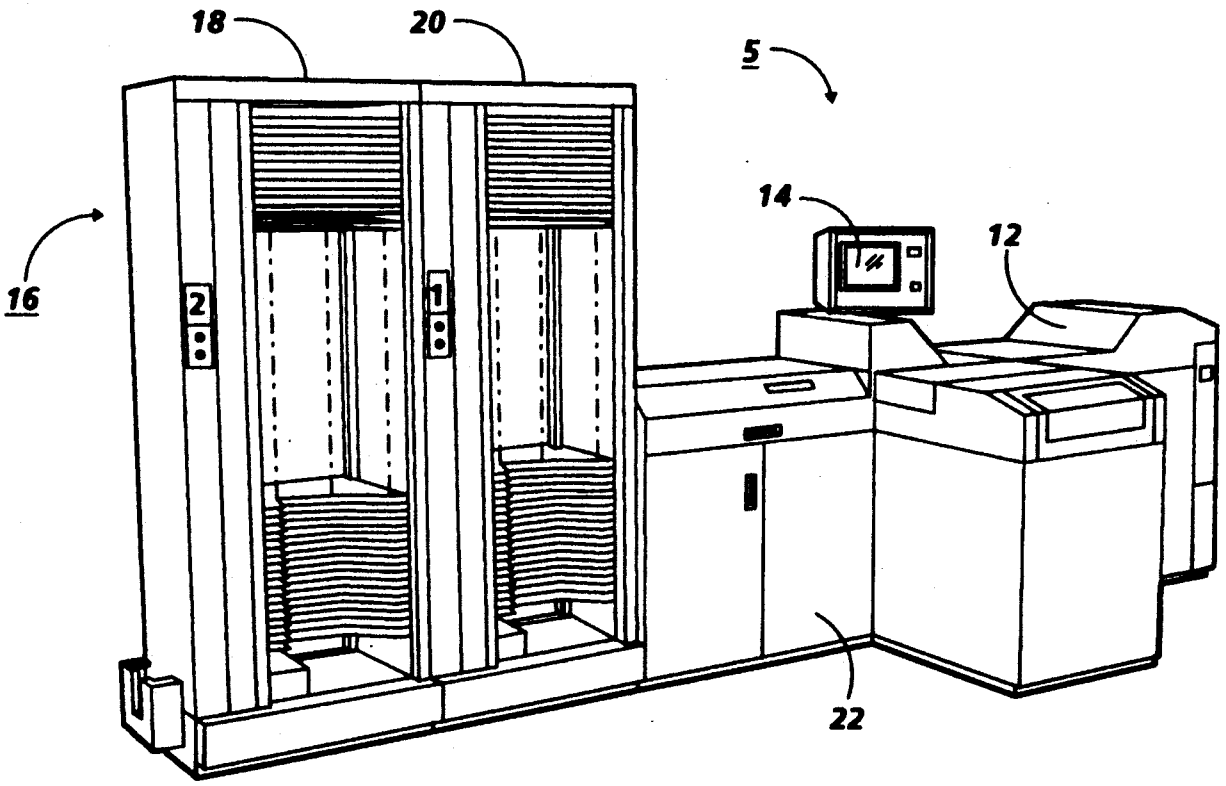
FIG. 1 is an isometric view of an illustrative reproduction machine incorporating the present invention.

For a general understanding of the features of the present invention, reference is made to the drawings. In the drawings, like reference numerals have been used throughout to identify identical elements. Referring to FIG. 1 there is shown an electrophotographic reproduction machine 5 composed of a plurality of programmable components and sub-systems which cooperate to carry out the copying or printing job programmed through a touch dialogue user interface. It will become evident from the following discussion that the unlimited document feeder and sorter control of the present invention may be employed in a wide variety of devices and is not specifically limited in its application to the particular embodiment depicted herein. For example, the document feeder although described as a recirculating document feeder can be any suitable automatic or semi automatic document feeder and the sorter towers can be any typical sorter devices for feeding copy sheets into bins.

Machine 5 as illustrated herein includes an imaging system shown generally at 12, a user interface 14, a sorting system 16, and a control interface 22 interconnecting the imaging system 12 including towers 18 and 20 of the sorting system 16.

Figure 2:
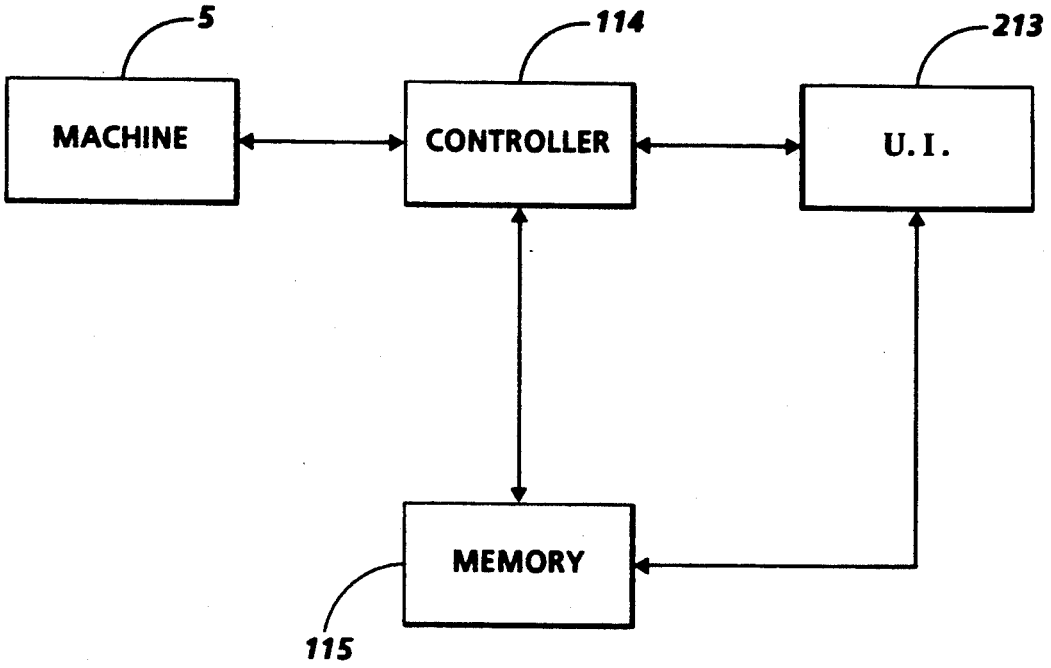
FIG. 2 is a block diagram of the operating control systems and memory for the machine shown in FIG. 1.

The various functions of machine 5 are regulated by any suitable controller 114 as shown in FIG. 2. which preferably comprises one or more programmable micro-processors. The controller 114 conventionally provides for storage and comparison of the counts of the copy and document sheets, the number of documents fed and recirculated in a document set, the desired number of copy sets, and other selections by the operator through a connecting panel of numerical and other control or function selection switches. Controller information and sheet path sensors are utilized to control and keep track of the positions of the respective document and the copy sheets and the operative components of the apparatus by their connection to the controller. The controller may be conventionally connected to receive and act upon jam, timing, positional, and other control signals from various sheet sensors in the document recirculation paths and the copy sheet paths. The controller automatically actuates and regulates the positions of sheet path selection gates depending upon which mode of operation is selected and the status of copying in that mode. The controller 114 also conventionally operates and changes displays on a connecting instructional display panel portion thereof which preferably includes said operator selection buttons or switches.

As will appear, programming and operating control over machine 5 is accomplished through a User Interface 213. Operating and control information, job programming instructions, etc. are stored in a suitable memory 115 which includes both ROM and RAM memory types, the latter being also used to retain jobs programmed through U.I. (User Interface) 213. And while a single memory is illustrated, it is understood that memory may comprise a series of discrete memories. Conventional sheet path sensors or switches may be utilized to keep track of the position of the documents and the copy sheets. In addition, the controller regulates the various positions of the gates depending upon the mode of operation selected.

Figure 3:
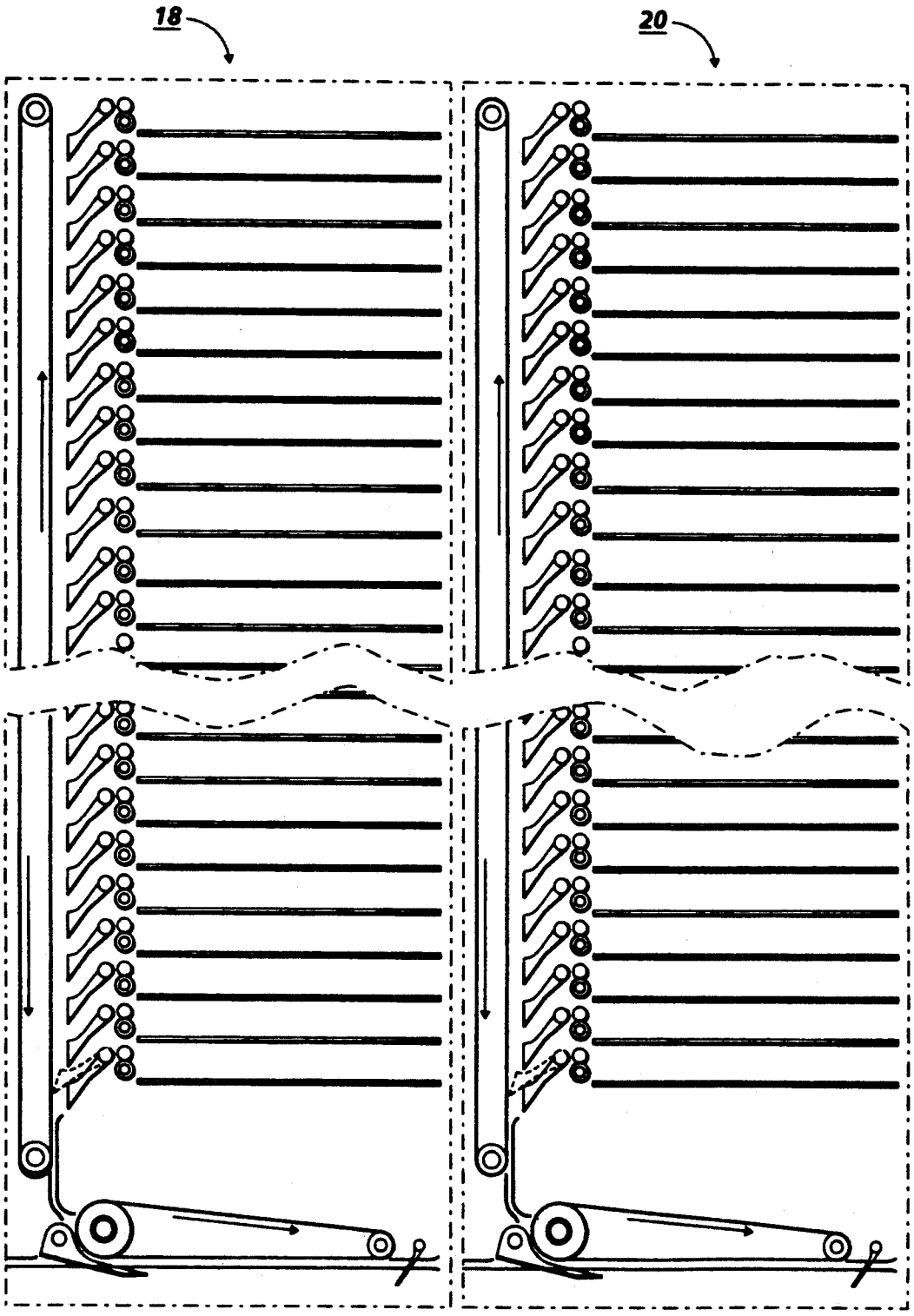
FIG. 3 is a schematic elevational view showing the finishing sub-system of the machine shown in FIG. 1.

Referring now to FIG. 3, the finishing station receives fused copies from rolls directly connected in a conventional manner to serially connected 60 bin tower sorters 52 and 54. The vertical bin arrays are conventionally gated to deflect a selected sheet into a selected bin as the sheet is conventionally transported past the bin entrance. Conventionally, the first tower 52 may be by passed by actuation of a gate therein to direct sheets serially on to the second tower, to increase the total number of bins available, and/or to alternately use the towers for limitless sorting.

Figure 4:
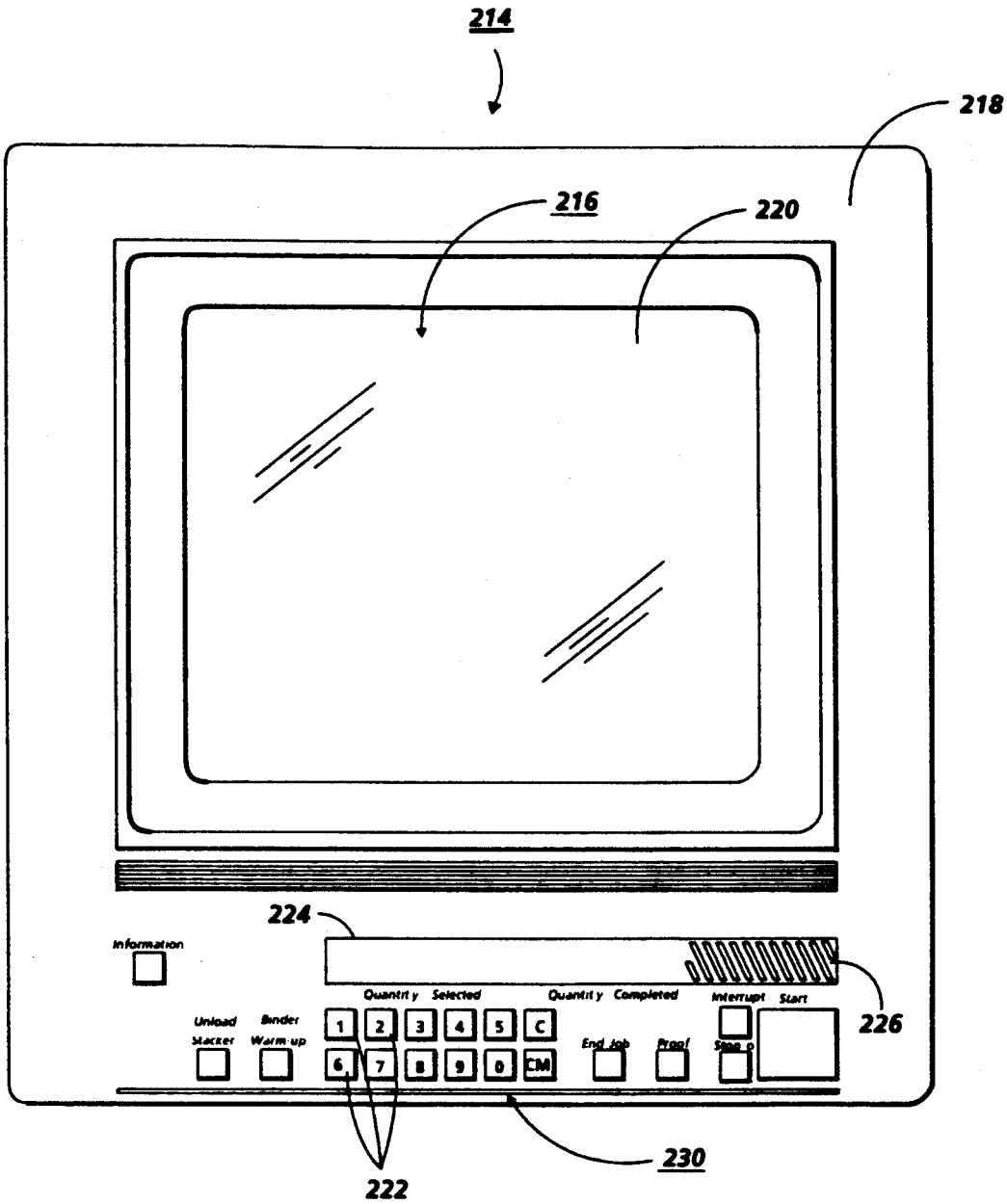
FIG. 4 is a front view of the U.I. touch monitor showing the soft button display screen and hard button control panel.

Referring to FIG. 4, there is shown a typical touch monitor 214 for the touch dialogue U.I.213. Monitor 214 provides an operator user interface with hard and soft touch control buttons enabling communication between operator and machine 5. Monitor 214 comprises a suitable cathode ray tube 216 of desired size and type having a peripheral framework forming a decorative bezel 218 thereabout. Bezel 218 frames a rectangular video display screen 220 on which soft touch buttons in the form of icons or pictograms and messages are displayed as will appear together with a series of hard control buttons 222 and 10 seven segment displays 224 therebelow. Displays 224 provide a display for copy "Quantity Selected", copy "Quantity Completed", and an area 226 for other information.

Hard control buttons 222 can comprise "0–9" buttons providing a keypad 230 for programming copy quantity, code numbers, etc.; a clear button "C" to reset display 224; a "Start" button to initiate print; a clear memory button "CM" to reset all dialogue mode features to default and place a "1" in the least significant digit of display 224; a "Stop" button to initiate an orderly shutdown of machine 5; an "Interrupt" button to initiate a job interrupt; a "Proof" button to initiate making of a proof copy; an "End Job" button to end the current job; and an "i" button to initiate a request for information.

Figure 5:
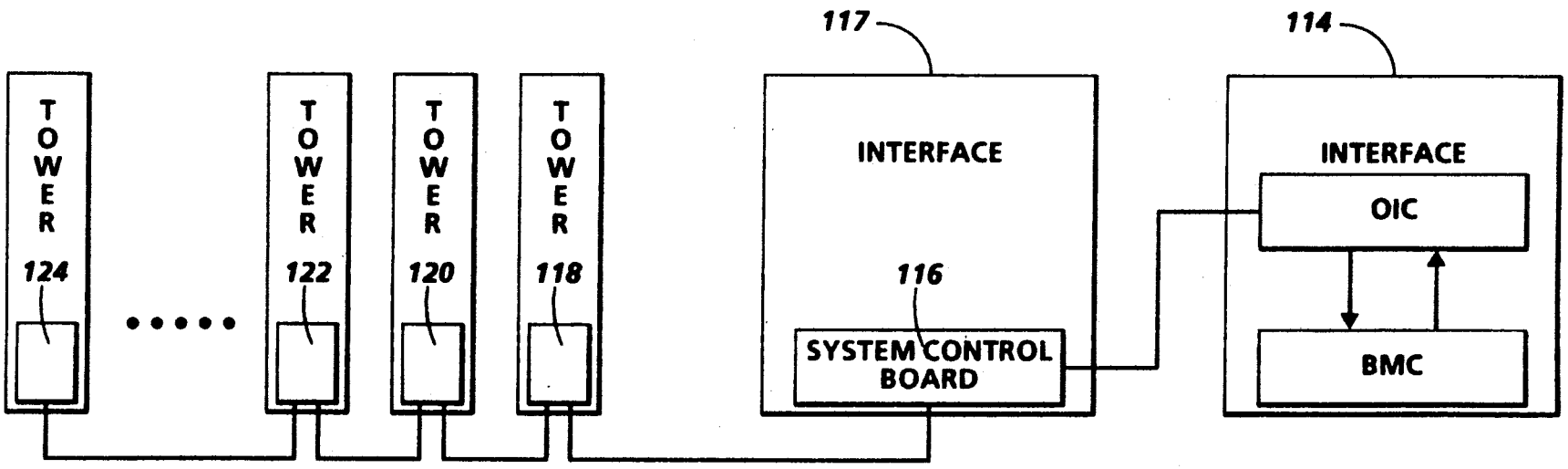
FIG. 5 is a block diagram illustration of the control of the finishing sub system.

With reference to FIG. 5, there is a general block diagram of the sorting towers control. The system controller 114 is interconnected to the interface control 116 via an RS 232 data link 118. A system control board 116 is in turn connected to the tower logic boards 118, 120, 122 and 124 of each of the towers that provide the sorting system. Requests for towers and bins available for distribution requirements are conveyed from the controller 114 to the system control board 116 of the interface 117, and the system control board responds to the controller 114 with bin and tower status information, empty status information, and other information such as copy sorted, jam and jam information.

Figure 6:
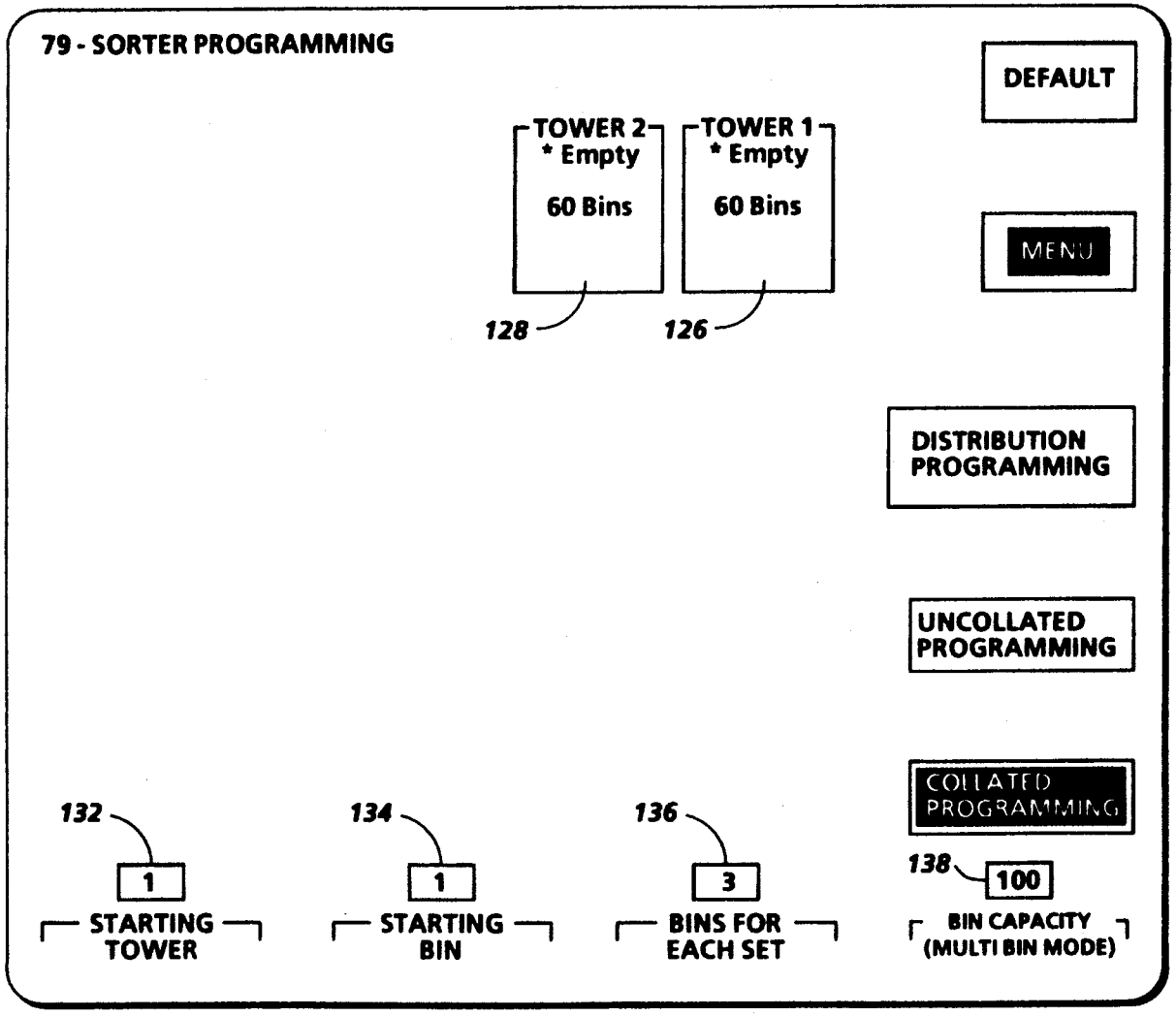
FIG. 6 is a front view of the touch monitor screen with the principal elements of the sorter dialogue in accordance with the present invention.

FIG. 6, is an illustration of a screen display for programming for collated sorting. One tower icon will appear for each tower in the machine configuration as illustrated 126 for tower 1, and 128 for tower 2, also providing empty status and the number of bins available. Engaging the collated programming button 130, as illustrated, will enable the operator to program the machine to produce and deliver copies to the sorter in collated order. To begin this operation, it is necessary for the operator to enter the number of the first tower where the output will be collated, as illustrated at 132. As shown the starting tower will be tower 1, but it should be understood that tower 1 could be bypassed to tower 2 or tower 3, or any designated tower to begin the sorting operation for the particular job at hand. The starting bin button, as illustrated at 134, is to enter the number of the first bin of the starting tower or where the collated output will be sent. Thus, as illustrated, the sorting operation will begin in tower 1 with bin 1, but depending upon other job requirements or jobs in process, the starting bin could be the second or third bin or any other bin of each 60 bin tower. Finally, the number of bins for each set must be designated at 136. Depending upon the bin capacity, the number of originals in the original set will dictate the number of bins required to get one complete collated copy set. If, in fact, more than one bin for each set is programmed, the bin capacity will appear and can be set as shown at 138. Thus, for example, in a specific embodiment, the bin capacity is 100 sheets. Thus, for a sorter job to collate a set of 225 original documents, at least 3 bins will be required. The capacity could be left at 100, thus requiring 2 bins of 100 each, and 1 bin of 25 sheets or the capacity could be set at 75 to put 75 sheets in each of the three bins to total 225.

Figure 7:
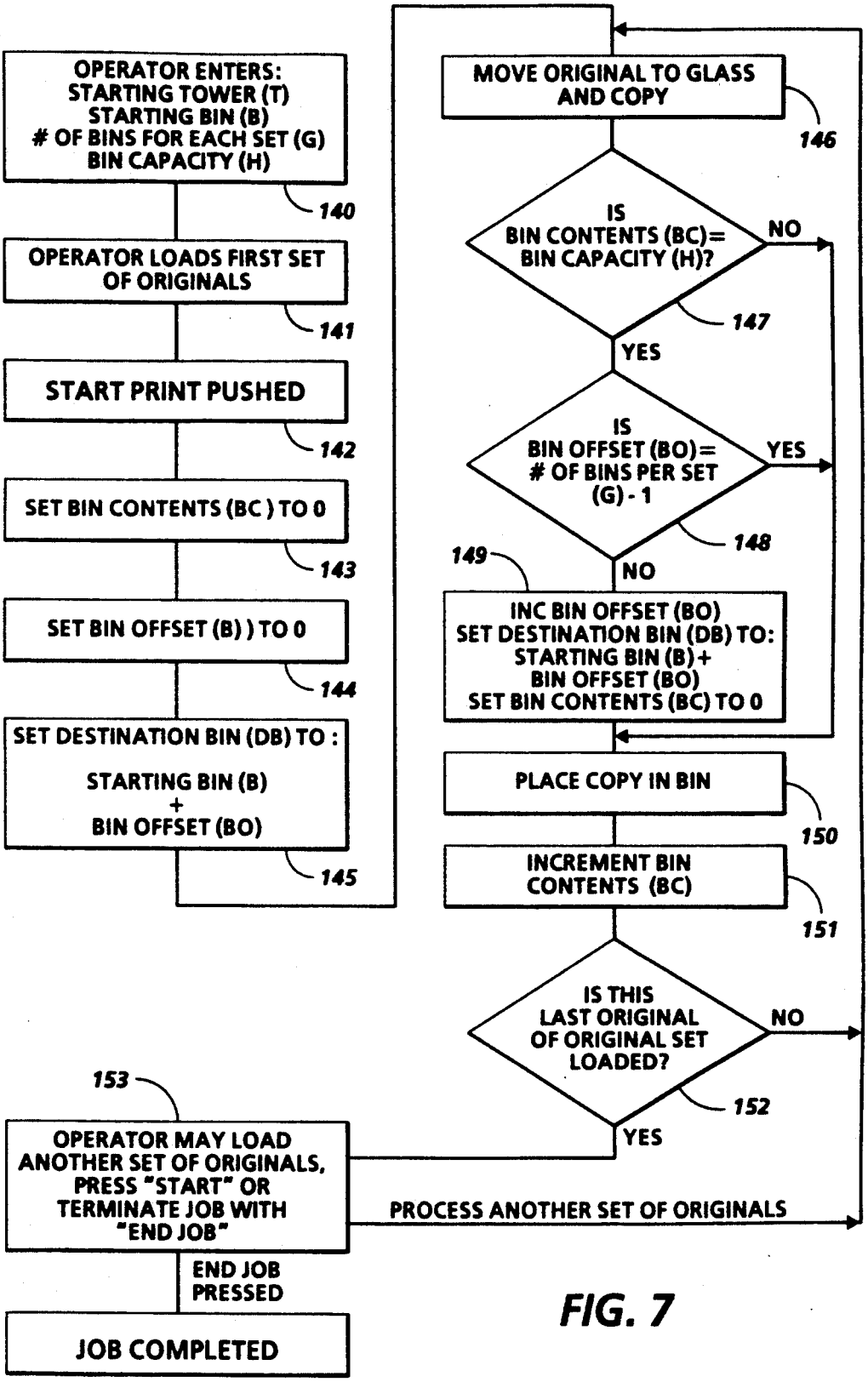
FIG. 7, is an illustrated flow chart of the sorter control in accordance with the present invention.

In operation, with reference to FIG. 7, the operator first enters the Starting Tower (T), the Starting Bin (B), the number of Bins per Set (G) and the Bin Capacity (H) of each bin as illustrated in block 140. The operator loads the first set of originals to be copied in block 141. The operator presses Start Print at block 142. At blocks 143, 144 and 145, the system initializes variables used to control the bin stepping process. The initial contents of each bin is set to 0 at block 143. In block 144 the ID of the bin within a group of bins (of the "Bins per Set") is set to 0 indicating no offset from the Starting Bin. In block 145 the destination bin is set to the selected Starting Bin (B) plus the Bin Offset (BO). On completion of the previously shown initialization, the first document is placed on the glass and copied at block 146.

At block 147 it is determined if the current bin is holding a number of copies equal to the specified bin capacity (H). If Bin Contents (BC) is less than bin capacity, the copy is placed in the current bin and Bin Contents (BC) is incremented. If the Bin Contents (BC) is equal to the Bin Capacity (H), a decision is made at block 148 to determine if the current bin is the last bin of the Bin Group consisting of Bins per Set (G) bins. If the current bin is the last bin of the group, the copy is still set to the last bin rather than sending it into the next bin which is in the bin group for the next set being compiled. This prevents a job integrity problem that could occur if the operator did not program the system such that Bin Capacity (H) multiplied by Bins per Set (G) is greater than or equal to the total number of originals submitted to the system. If Bin Offset (BO) was not equal to Bins per Set (G)-1 at block 148, then at block 149 (BO) will be incremented and added to Starting Bin (B) to determine the Destination Bin (DB). Bin Contents (BC) is then reset to 0.

The copy is then placed in the Destination Bin (DB) at block 150 and the Bin Contents (BC) incremented at block 151. At block 152, if it is determined that the current original is the last original in the document handler the system will, at block 153, wait for the operator to either load another set of originals and press Start Print or press "End Job" to terminate the job. If the operator loads another set of originals and presses Start Print, the process will continue with block 146. The act of continuing the job with another set of originals does not directly effect the bin stepping process, since it is only dependent on sheets delivered.

While the invention has been described with reference to the structure disclosed, it is not confined to the details set forth, but is intended to cover such modifications or changes as may come within the scope of the following claims.

I claim:

1. In a printing machine having an automatic document feeder and a sorter, the sorter including a plurality of sections, each section having a plurality of bins, the automatic document feeder having a given document capacity, the method of allocating the sorter sections and bins to produce a predetermined number of sets of an unlimited set of original documents comprising the steps of;

entering into the machine the predetermined number of sets of the original set required to complete a job demand, loading a first set of originals into the automatic document feeder, determining the number of bins and the number of sections of the sorter needed to complete the predetermined number of sets of the original set required, the step of determining the number of bins and the number of sections of the sorter needed to complete the predetermined number of sets of the original set required including the steps of allocating the bins to provide the requisite capacity to receive the required number reproductions of a given original of the original set and allocating the sections of the sorter to provide the requisite capacity to receive the required number reproductions of each original of the original set, initiating the operation of the machine to complete the requirement for the first set of originals loaded into the automatic document feeder, instructing the operator to reload the automatic document feeder with a second set of original documents, initiating the operation of the machine to complete the requirement for the second set of originals loaded into the automatic dot feeder, and repeating the step of instructing the operator to reload the automatic document feeder with additional sets of original documents until the completion of the job demand.

2. In a printing machine having an automatic document feeder and a sorter, the sorter including a plurality of sections, each section having a plurality of bins, each bin having a selected capacity limit the automatic document feeder having a given document capacity, the method of allocating the sorter sections and bins to produce a predetermined number of sets of an original document set comprising the steps of;

determining the number of bins at said selected capacity limit and the number of sections of the sorter needed to complete the predetermined number of sets of the original set required, initiating the operation of the machine to complete the requirement for a first set of originals loaded into the automatic document feeder, reloading the automatic document feeder with a second set of original documents, initiating the operation of the machine to complete the requirement for the second set of originals loaded into the automatic document feeder, and repeating the step of reloading the automatic document feeder with additional sets of original documents until the completion of the predetermined number of sets of the original document set, including the step of removing the capacity limit from a bin to prevent overflow sheets from a set from entering the next bin to maintain completed set integrity.

* * * * *